US008256936B2

(12) United States Patent
Liu et al.

(10) Patent No.: US 8,256,936 B2
(45) Date of Patent: Sep. 4, 2012

(54) ELECTRONIC CANDLE ASSEMBLY

(75) Inventors: Zhen-Bao Liu, Shenzhen (CN); Wei-Te Lin, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 375 days.

(21) Appl. No.: 12/702,320

(22) Filed: Feb. 9, 2010

(65) Prior Publication Data

US 2010/0270946 A1 Oct. 28, 2010

(30) Foreign Application Priority Data

Apr. 24, 2009 (CN) ..... 2009 1 0301819

(51) Int. Cl.
*F21S 4/00* (2006.01)
*H05B 37/02* (2006.01)

(52) U.S. Cl. ..... 362/392; 362/800; 315/294

(58) Field of Classification Search ..... 362/800, 362/806, 810, 161, 392, 447; 315/291, 294, 315/307, 312

See application file for complete search history.

(56) References Cited

U.S. PATENT DOCUMENTS

| | | | | |
|---|---|---|---|---|
| 6,981,786 | B2 * | 1/2006 | Yao et al. | 362/392 |
| 7,066,637 | B2 | 6/2006 | Nozawa et al. | |
| 2004/0196658 | A1 * | 10/2004 | Fung | 362/392 |
| 2005/0007779 | A1 * | 1/2005 | Nozawa et al. | 362/253 |
| 2007/0230197 | A1 * | 10/2007 | Scannell | 362/418 |

FOREIGN PATENT DOCUMENTS

| | | | |
|---|---|---|---|
| CN | 1578573 | A | 2/2005 |
| CN | 201000054 | Y | 1/2008 |

* cited by examiner

*Primary Examiner* — Tung X Le
(74) *Attorney, Agent, or Firm* — Altis Law Group, Inc.

(57) ABSTRACT

An electronic candle assembly includes a plurality of electronic simulation candles, a main body supporting the electronic simulation candles, a power supply for supplying power, and a sensor system received in the main body. Each electronic simulating candle includes an illuminating device. The sensor system includes a plurality of sensors, an analog-to-digital convertor, a storage unit, and a processor. The sensors measure the velocity of air current traveling through the illuminating device and outputting the velocity of the air current as an analog electrical signal. The analog-to-digital convertor converts analog electrical signal into a digital signal. The storage unit stores predetermined velocity values and predetermined modes for powering the illuminating device. The processor compares the digital signal with the predetermined velocity and controlling the power supply to power the illuminating device in a predetermined mode.

9 Claims, 3 Drawing Sheets

ELECTRONIC CANDLE ASSEMBLY

BACKGROUND

1. Technical Field

The present disclosure relates to electronic candles.

2. Description of Related Art

Electronic candles that have the shape and pattern of a conventional candle are widely used. The electronic candles are internally provided with illuminating devices emitting light outward to enhance the outer appearance. However, the conventional electronic candles are not interactive and cannot simulate a traditional candles flickering or being extinguished by the wind, thereby limiting the versatility of the conventional electronic candle.

BRIEF DESCRIPTION OF THE DRAWINGS

The components of the drawings are not necessarily drawn to scale, the emphasis instead being placed upon clearly illustrating the principles of the embodiments of an electronic candle assembly. Moreover, in the drawings, like reference numerals designate corresponding parts throughout several views.

DETAILED DESCRIPTION

Figure 1:
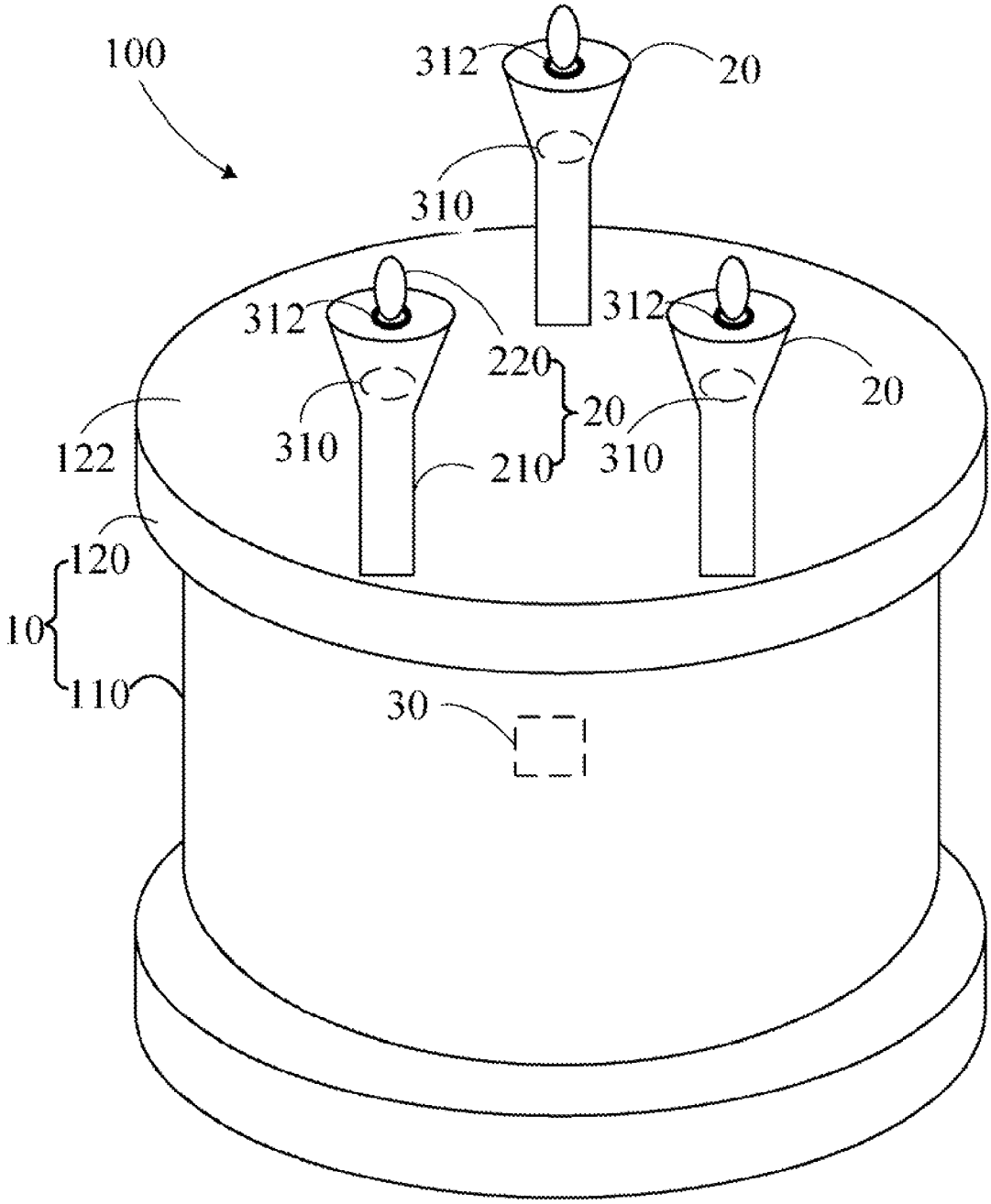
FIG. 1 is a schematic view of an electronic candle assembly in accordance with an embodiment.

Referring to FIG. 1, an electronic candle assembly 100 in accordance with an exemplary embodiment is shown. The electronic candle assembly 100 includes a main body 10, a plurality of electronic candles 20 fixed on the top of the main body 10, and a sensor system 30 received within the main body 10. The electronic candle assembly 100 further includes a power supply 40 for supplying electrical power to the plurality of electronic candles 20.

The main body 10 has a hollow body 110 and a lid 120 releasably engageable with the body 110. A plurality of electronic candles 20 are arranged at a top surface 122 of the lid 120. In the embodiment, the main body 10 is a faux cake; the number of the electronic candles 20 is three.

The electronic candle 20 includes a base 210 and an illuminating device 220 fixed to a top end of the base 210. The base 210 is configured for stably setting the illuminating device 220 on the main body 10. The illumination device 220 has a candle flame shape and illuminates to provide a simulated lit wax candle effect. The illuminating device 220 can be a light emitting diode (LED) or any other electrical lamp.

Figure 2:
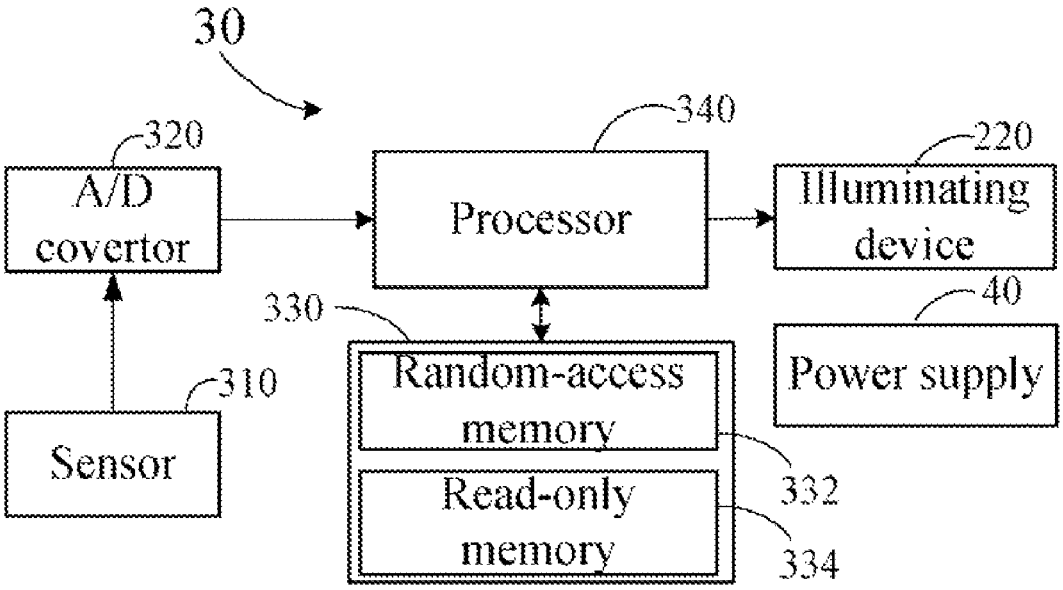
FIG. 2 is a functional block diagram of a sensor system of the electronic candle assembly of FIG. 1.

Referring also to FIG. 2, the sensor system 30 includes three sensors 310, an analog-to-digital (A/D) convertor 320 electrically connected to the three sensors 310, a processor 340 electrically connected to the A/D convertor 320, and a storage unit 330 electrically connected to a processor 340. The three sensors 310 are fixed to the three electronic candles 20 correspondingly.

The sensors 310 are configured for measuring velocities of air current traveling through the illuminating devices 220, and outputting the velocities of the air current as analog electrical signals. In the embodiment, each sensor 310 includes an anemometer 312. Referring to FIG. 1, the anemometers 312 are fixed to the bottom end of the corresponding illuminating devices 220, so the sensors 310 can detect an air current.

The A/D convertor 320 is configured for converting the analog electrical signals into digital signals.

The storage unit 330 includes a random-access memory 332 and a read-only memory 334. The random-access memory 332 is configured for temporarily storing the digital signals. The read-only memory 334 is configured for storing predetermined velocity values, and predetermined modes that power the illuminating device 220. In the embodiment, the read-only memory 334 stores two predetermined velocity values V1 and V2(V1<V2). The predetermined modes powering the illuminating device 220 include a constant power mode, an alternating power mode, and a power-off mode.

In the embodiment, when the illuminating device 220 is in the constant power mode, the power supply 40 supplies constant electrical power to the illuminating device 220 and the illuminating device 220 illuminates steadily. When in the alternating power mode, the power supply 40 supplies the illuminating device 220 with alternating power, the illuminating device 220 flickers. When in the power-off mode, the power supply 40 stops supplying the power to the illuminating device 220, the illuminating device 220 turns off.

The processor 330 is configured for comparing the digital signal, corresponding to the measured velocity value, with predetermined velocity values, and controlling the illuminating device 220 to illuminate in a predetermined mode according to a comparing result. In detail, firstly, the processor 340 first reads the digital signal and the predetermined velocity value, and then compares the digital signal and the predetermined velocity value, and finally the power supply 40 controls the illuminating device 220 to illuminate in a predetermined mode.

For example, a velocity value V is measured by the sensors 310, when V is larger than V2, the processor 340 controls the power supply 40 to power-off the illuminating device 220. In detail, the processor 340 controls the power supply 40 to stop supply the electrical power to the illuminating device 220, that is, the illuminating device 220 is turned off.

When V is less than V1, the processor 340 controls the power supply 40 powering the illuminating device 220 in a constant power mode, in detail, the processor 340 controls the power supply 40 to continue the power to the illuminating device 220 steadily.

When V is larger than or equal to V1, and is less than or equal to V2, the processor 340 controls the power supply 40 powering the illuminating device 220 in an alternating power mode. In detail, the processor 340 controls the power supply 40 to supply the illuminating device 220 with an alternating power, thus, the illuminating device 220 flickers in response to the alternating power.

In operation, the electronic candle 100 can automatically turn off the illuminating device 220 when the illuminating device 220 is subjected to a strong air current blowing on it. For example, when a person blows on the illuminating device 220, the air current travels through the illuminating device 220 with a velocity V(V>V2). The sensors 310 measure the velocity V and output to the processor via the A/D convertor 320. The processor 340 compares the velocity V with the predetermined values V1 and V2. The processor 304 controls the power supply 40 to power-off the illuminating device 220 according to the comparison.

Figure 3:
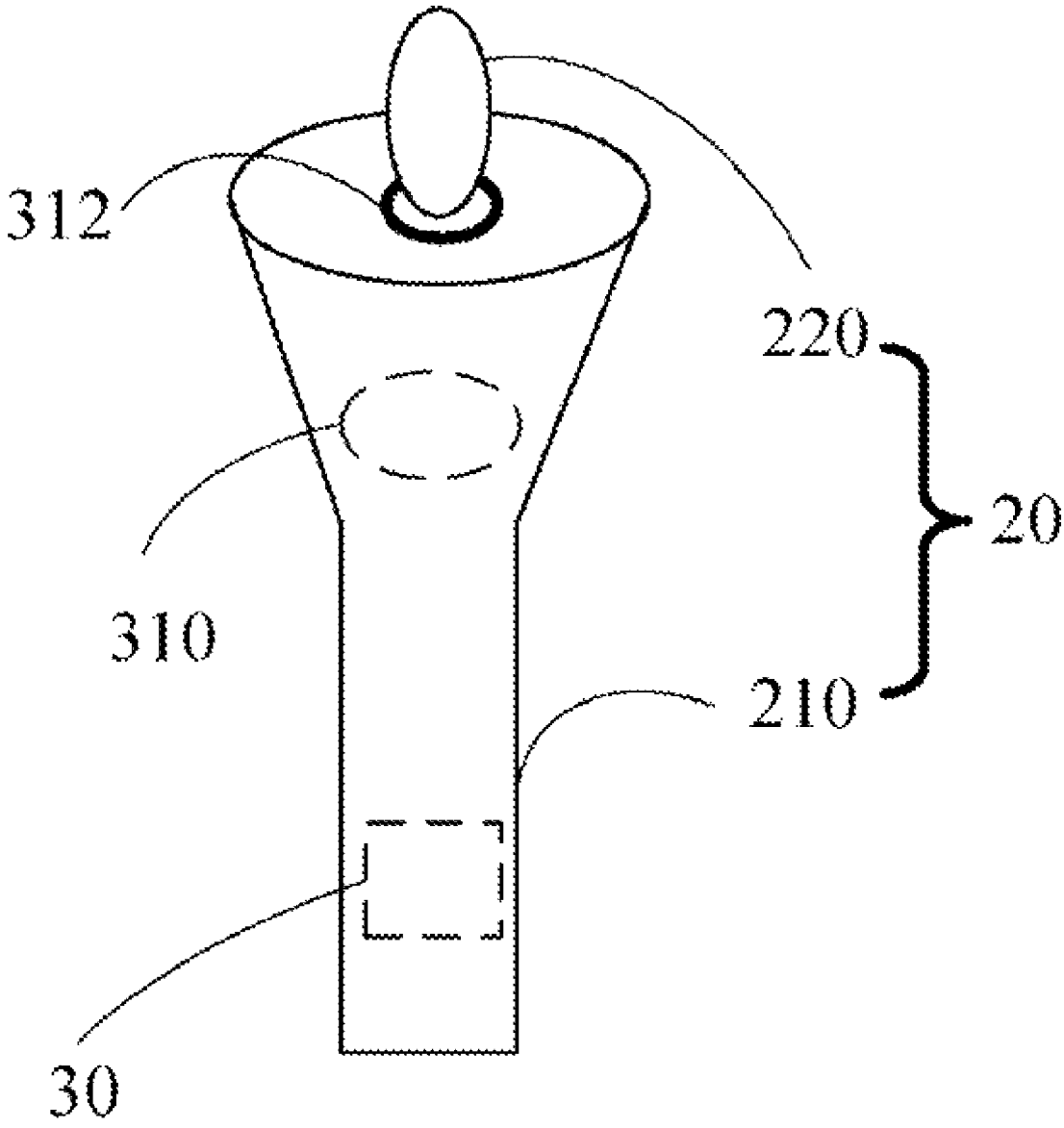
FIG. 3 schematic view of an electronic candle assembly in accordance with another embodiment.

Referring to FIG. 3, in other embodiment, the electronic candle assembly 200 includes an electronic candle 20 and a sensor system 30. The electronic candle 20 includes a hollow base 210 and an illuminating device 220 fixed on the base 210. The difference between the electronic candle assemblies 100 and 200 is that the sensor system 30 of the electronic candle assembly 200 is assembled in the base 210.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An electronic candle assembly, comprising:

at least one electronic candle comprising an illuminating device;

a main body for supporting the at least one electronic candle;

a power supply for powering the illuminating device; and a sensor system received in the main body, the sensor system comprising:

at least one sensor configured for measuring a velocity of air current traveling through the illuminating device and outputting electrical signals representing the velocity value of air current;

a storage unit configured for storing predetermined velocity values and corresponding predetermined modes that power the illuminating device, the predetermined modes comprising a constant powering mode, a powering-off mode and an alternating powering mode; and a processor for receiving the electrical signals and comparing the velocity of the air current with the predetermined velocity value and controlling the power supply to power the illuminating device in a predetermined mode;

wherein the predetermined velocity values comprise a first value and a second value greater that the first value, when the velocity of air current is larger than the second value, the illuminating device is powered in the powering-off mode; when the velocity of air current is less than or equal to the first value, and is larger than or equal to the second value, the illuminating device is powered in the alternating powering mode; when the velocity of air current is less than the first value, the illuminating device is powered in the constant powering mode.

2. The electronic candle assembly of claim 1, wherein each of the at least one sensor comprises an anemometer, the anemometer is fixed to the bottom end of the illuminating device and is configured for measuring the velocity of the air current traveling through the illuminating device.

3. The electronic candle assembly of claim 1, wherein the illuminating device has a candle flame shape and illuminates so as to provide a simulated illuminated wax candle effect.

4. The electronic candle assembly of claim 1, wherein the sensor system further comprises an analog-to-digital (A/D) convertor and the A/D convertor is configured for converting analog electrical signals into digital signals.

5. The electronic candle assembly of claim 1, wherein when the illuminating device is powered in the constant powering mode, the illuminating device illuminates constantly, and when the illuminating device is powered in the powering-off mode, the illuminating device is turned off, and when the illuminating device is powered in the alternating powering mode, the illuminating device flickers.

6. An electronic candle, comprising:

an illuminating device having a candle flame shape and being capable of illuminating so as to provide a simulated illuminated wax candle effect;

a power supply for powering the illuminating device; and a sensor system electrically connected to the illuminating device and the power supply, the sensor system comprising:

at least one sensor configured for measuring the velocity of air current traveling through the illuminating device and outputting the velocity of the air current as an analog electrical signal;

a storage unit configured for storing predetermined velocity values and predetermined modes that power the illuminating device, the predetermined modes comprising a constant powering mode, a powering-off mode, and an alternating powering mode; and a processor for receiving the electrical signals and comparing the velocity of the air current with the predetermined velocity and controlling the power supply to power the illuminating device in a predetermined mode;

wherein the predetermined velocity values comprise a first value and a second value greater that the first value, when the velocity of air current is larger than the second value, the illuminating device is powered in the powering-off mode; when the velocity of air current is less than or equal to the first value, and is larger than or equal to the second value, the illuminating device is powered in the alternating powering mode; when the velocity of air current is less than the first value, the illuminating device is powered in the constant powering mode.

7. The electronic candle of claim 6, wherein each of the at least one sensor comprises an anemometer, the anemometer is fixed to the bottom end of the illuminating device and is configured for measuring the velocity of air current traveling through the illuminating device.

8. The electronic candle of claim 6, wherein the sensor system further comprises an analog-to-digital (A/D) convertor, the analog-to-digital (A/D) convertor is configured for converting analog electrical signal into a digital signal.

9. The electronic candle of claim 6, wherein when the illuminating device is powered in the constant powering mode, the illuminating device illuminates constantly, and when the illuminating device is powered in the powering-off mode, the illuminating device illuminating is turned off, and when the illuminating device is powered in the alternating powering mode, the illuminating device flickers.

* * * * *